United States Patent [19]

Irie

[11] Patent Number: 4,911,364

[45] Date of Patent: Mar. 27, 1990

[54] WATER PISTOL

[75] Inventor: Kenji Irie, Osaka, Japan

[73] Assignee: Ken Ken Co., Ltd., Osaka, Japan

[21] Appl. No.: 309,344

[22] Filed: Feb. 10, 1989

[51] Int. Cl.[4] ..... B05B 17/00

[52] U.S. Cl. ..... 239/289; 239/329; 222/79; 272/27 W

[58] Field of Search ..... 272/1 B, 27 R, 27 N, 272/27 W; 124/56, 63, 65, 64, 90; 239/211, 289, 329; 222/79

[56] References Cited

U.S. PATENT DOCUMENTS 1,394,456 10/1921 Wanat ..... 124/65 X
3,197,070 7/1965 Pearl et al. ..... 222/79
4,605,223 8/1986 Rainville ..... 124/63 X
4,733,799 3/1988 Wiskur ..... 124/65 X

*Primary Examiner*—Andres Kashnikow
*Assistant Examiner*—Kevin P. Weldon
*Attorney, Agent, or Firm*—Wenderoth, Lind & Ponack

[57] ABSTRACT

In this invention a water pistol is eliminated the necessity of the application of strong power at the time the water is shot by utilizing the restoring power of a bow-string which is strung to a bow-shaped structure and used to push the rod. Moreover, this invention provides a means to increase the pressure on the water in a pressure compartment stably so that it is possible to stabilized the trajectory of the water forced from a nozzle of the water pistol.

2 Claims, 4 Drawing Sheets

WATER PISTOL

BACKGROUND OF THE INVENTION 1. (Field of the Invention)

The invention, herein described, relates to a water pistol which can shoot water under greater than usual pressure with subsequent greater accuracy at a target from a hole in the nozzle structure of the water pistol.

2. (Description of the Prior Art)

It is well known that until the present time many types of water pistols have been produced. A typical example of the water pistol consists of a cylinder which has a hole in its front or bottom wall and thus acts as a nozzle; inside the cylinder a rod-shaped object constructed as a piston is able to move back and forth; the wall of the cylinder and the piston form a pressure compartment when the piston part is positioned so it tightly closes up the nozzle hole of the cylinder; when the rod and its piston part are pulled back water is drawn away from the nozzle outlet into the pressure compartment of the cylinder; then when the rod and piston are forced by hand to return forward increased pressure is applied to the water in the cylinder and it is forced out the nozzle outlet in the direction of the target.

SUMMARY OF THE INVENTION

In previously developed types of water pistols since the means of increasing the pressure of the water in the pressure compartment is the pushing of a rod by hand, considerable power is required. Furthermore, since the power is supplied by hand the pressure is often not applied steadily and thus the trajectory of the water forced from the hole of the nozzle is not fixed stably. And so the percentage of hits which successfully reach the target is low.

Therefore, the purpose of this invention is to eliminate the necessity of the application of strong power at the time the water is shot by utilizing the restoring power of a bowstring which is strung to a bow-shaped structure and used to push the rod. Moreover, this invention provides the mean to increase the pressure on the water in the pressure compartment stably so that it is possible to stabilize the trajectory of the water forced from the nozzle of the water pistol.

This invention achieved its purpose by stringing a bowstring between the opposite edges of the curve of a bow-shaped structure which has a cylinder-shaped chamber fixed to its center.

The chamber consists of a pressure compartment of changeable capacity for holding water and a guide part which can be moved toward the bowstring side of the device at the rear of the pressure compartment. On the front wall of the chamber is a hole connecting the pressure oompartment with a nozzle structure. A rod is set inside the guide part which is able to move back and force with its rear edge connected to the central point of the bowstring. Either the bow-shaped structure or the bowstring is made of an elastic material so that the restoring power of either bowstring or bow-shaped structure forces the rod forward after it has been drawn back with the bowstring.

Thus, the rod increases the pressure on the water in the pressure compartment of the chamber against its front wall and subsequently water is discharge through the hole of the nozzle.

Due to the construction of the device as described in the previous section when the bowstring is strung with the rod drawn backwards against it, aim taken at a target and then the rod release, the bowstring moves forward propelling the rod inside the guide part of the chamber with the force of the restoring power of the elastic material of either the bowstring or the bow-shaped structure.

The forward movement of the rod reduces the capacity of the pressure compartment inside the chamber and thus increases the pressure on the water it contains. As a result, the water inside the pressure compartment is discharged from the hole of the nozzle towards the target. Since the restoring power of the bow-shaped structure or of the bowstring is utilized to increase the pressure on the water in the pressure compartment it is not necessary to increase the pressure at the point the water is actually discharged. And so the little amount of power required to string the bowstring by moving the rod backwards is sufficient.

In addition, since the pressure on the water inside the pressure compartment is increased by taking advantage of the restoring power of the bow-shaped structure or of the bowstring as mentioned above, the application of increased pressure is definite resulting in a stable trajectory of discharged water that allows a greater than usual percentage of target hits than with presently existing water pistols.

DESCRIPTION OF THE DRAWINGS

The drawings illustrate various embodiments of the present invention.

DETAILED DESCRIPTION OF THE PREFERRED EMBODIMENT

The description of the various embodiments of the present invention based on the illustrative drawings is as follows.

Figure 3:
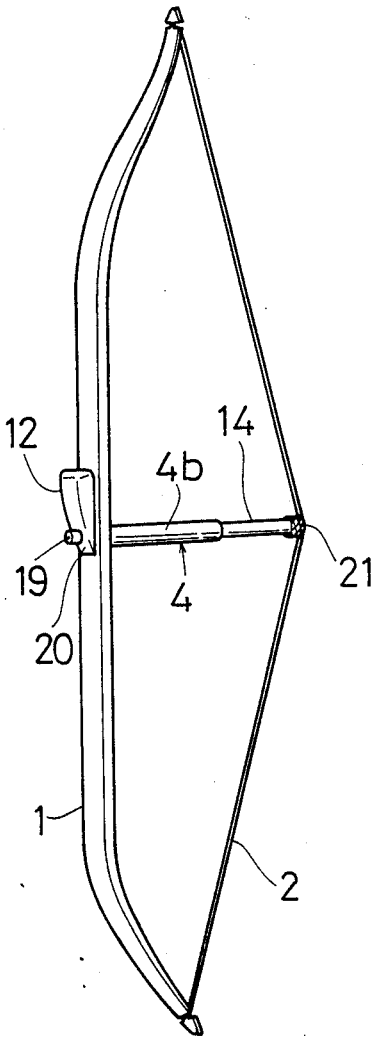
FIG. 3 is an illustration of the whole water pistol.
Figure 4:
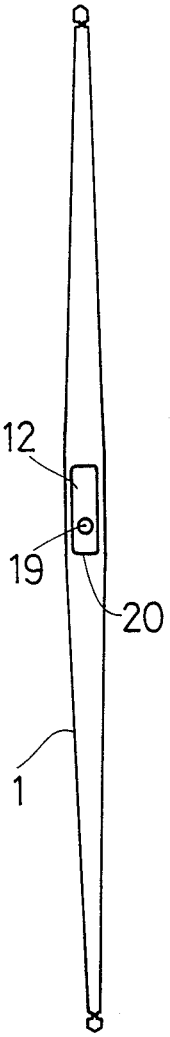
FIG. 4 is a front view of the water pistol.
Figure 5:
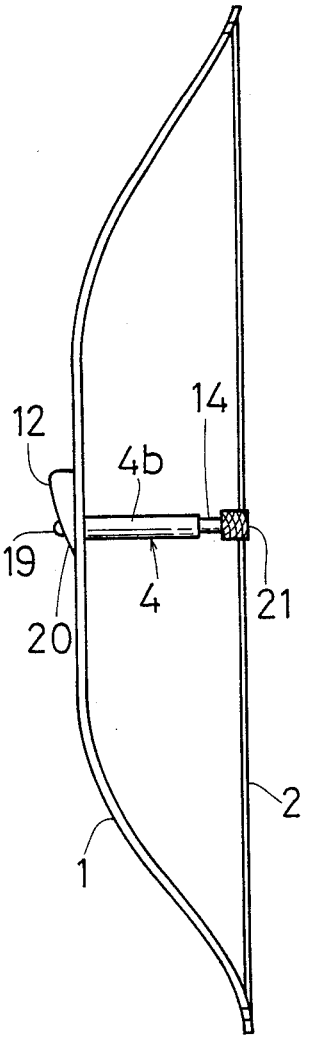
FIG. 5 is a side view of the water pistol.
Figure 6:
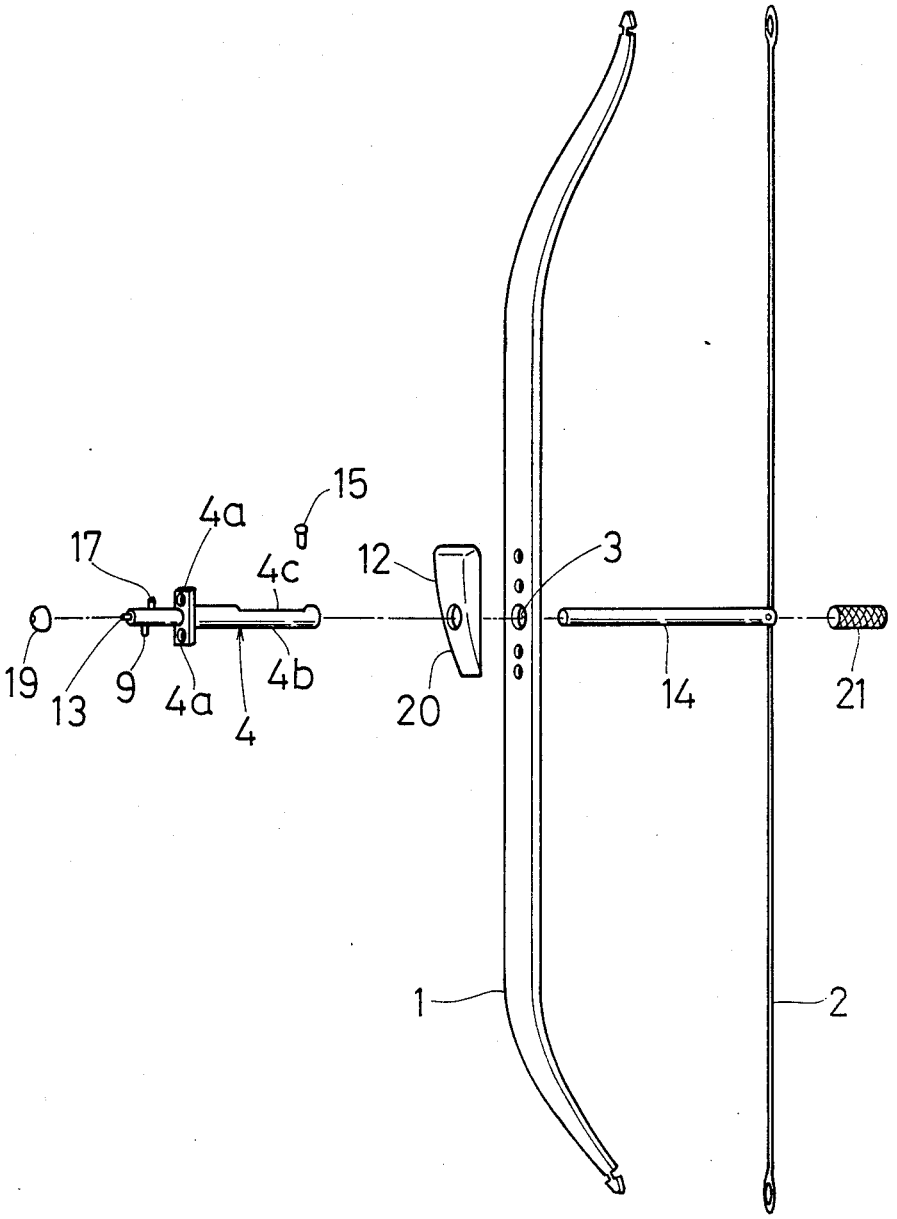
FIG. 6 is an illustration of the water pistol broken down into its component parts.

FIG. 3 and FIG. 6 illustrate the whole construction of a water pistol which is an embodiment of this invention.

A bow-shaped structure 1 is bent backward at both ends to form a curve and is made of an elastic material such as fiber glass or a similar material.

A bowstring 2 is stretched between both end edges of the bow-shaped structure 1.

Figure 1:
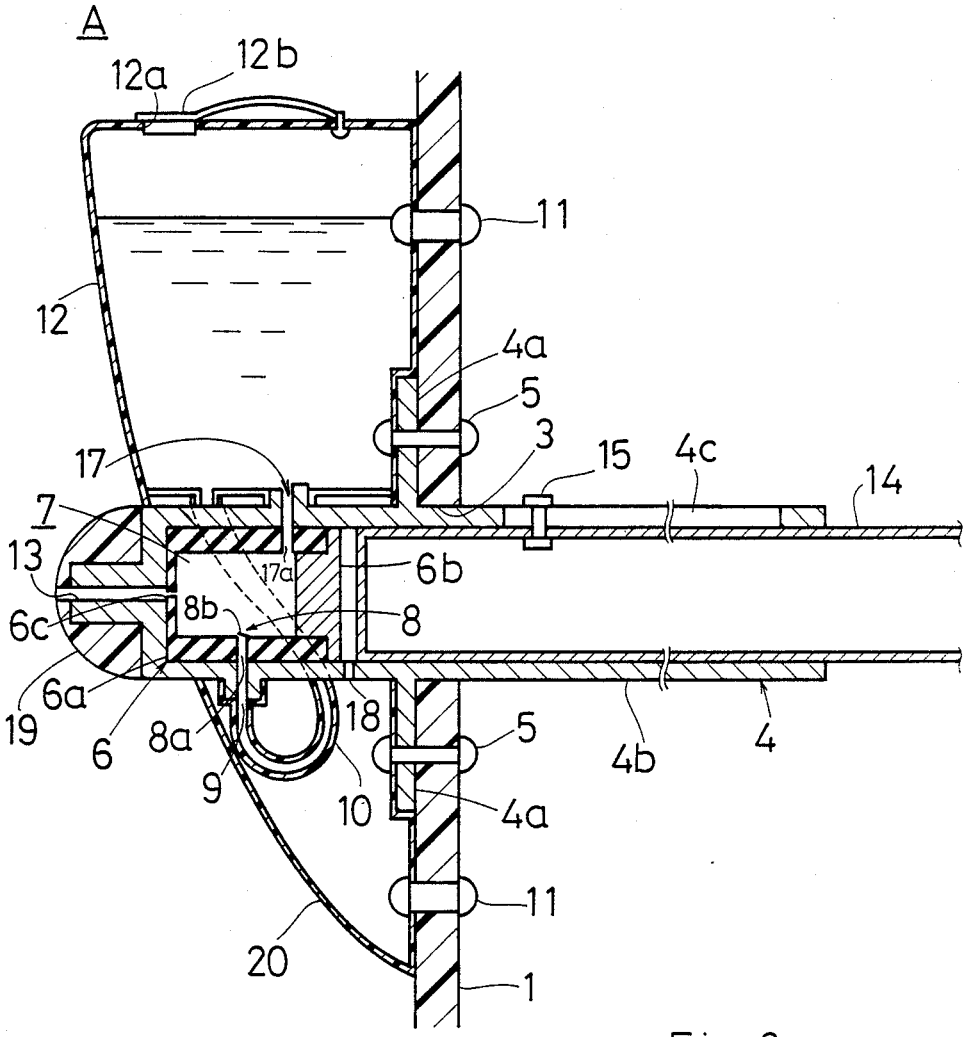
FIG. 1 is an enlarged sectional view of the significant part of the invention.

When the bowstring 2 is drawn backwards at the middle it curves the bow-shaped structure 1 until a position of stability is achieved. The restoring power of the bow-shaped structure 1 is able to force the middle part of the bowstring 2 forward FIG. 1 shows an enlarged sectional view of the bow-shaped structure 1.

A cylinder-shaped chamber 4 is set in a round hole formed in the center of he bow-shaped structure 1. The chamber 4 is fixed perpendicularly to the bow-shaped structure 1 by a rivets 5 at a flange 4*a*.

A box-shaped chamber 6 is rigidly fixed to the front wall of the chamber 4.

The chamber 6 consists of a bucket-shaped structure 6a which is made of a highly elastic material such as rubber and a cap 6b which is made of a solid material such as metal and covers the opening of the bucket-shaped structure 6a. Except for the bottom of the chamber 6 the rest of it is slightly movable within the chamber 4.

A pressure compartment 7 which has a variable capacity due to the elasticity of the bucket-shaped structure 6a is formed inside the chamber 6 for the purpose of containing water.

A check valve 8 which consists of a hole 8a in the wall of the bucket-shaped structure 6a and a reed valve 8b is formed on the bottom wall of the pressure compartment 7.

The reed valve 8b is constructed on the lower wall of the bucket-shaped structure 6a so that it can flap freely in order to close the hole 8a.

The hole 8a is connected to one end of an inlet pipe 10 through an inlet opening 9 which is in the bottom wall of the chamber 4.

The other end of the inlet pipe 10 is connected to a water tank 12 which is fixed to the bow-shaped structure 1 by the rivets 5, 11 on the top of the chamber 4.

The check valve 8 allows water to pass from the water tank 12 to the pressure compartment 7 through the hole 8a, but prevents any reverse movement of the water.

The chamber 4 contains the cylindrical guide part 4b which extends towards the middle of the bowstring 2.

The chamber 6 which is in the front section of the chamber 4 has a small hole 6c which connects the pressure compartment 7 with a nozzle hole 13 which is in the center of the front part of the chamber 4.

A cylindrical hollow rod 14 is set to slide freely inside the guide part 4b.

A pin 15 which stands on the front part of the outer wall of the rod 14 is fixed so that it slides freely along a slit 4c which runs lengthwide through the guide part 4b.

The combination of the pin 15 and the slit 4c controls the stroke-length of the rod 14 and prevents the rod 14 disconnecting from the chamber 4.

Figure 2:
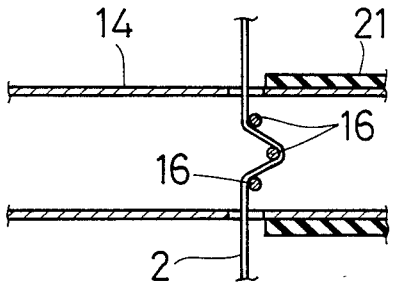
FIG. 2 is a sectional view which shows the construction of the connection of the bowstring with the rod.

FIG. 2 shows an enlarged sectional view of the rear end of the rod 14. The rear end of the rod 14 is fixed parmanently to the middle of the bowstring 2 by three pins 16 fixed diameterwise in zigzag fashion to hold the rod 14 to the bowstring 2.

When the bowstring 2 and the rod 14 are drawn backwards the bow-shaped structure 1 is curved until a position of stability is achieved. The restoring power of the bow-shaped structure 1 is able to force the rod 14 forwards so that the front end of the rod 14 strikes the rear of the cap 6b.

The cap 6b moves slightly forwards due to the elasticity of the bucket-shaped structure 6a so that the capacity of the pressure compartment 7 is reduced, subsequently increasing the pressure on the water it contains. Thus, some of the water is forced out through the small hole 6c and the nozzle hole 13.

In FIG. 1, a path 17 is a breathing path which connects the upper part of the pressure compartment 7, the water tank 12 and an opening 17a between the path 17 and the pressure compartment 7. The path 17 is closed by the cap 6b as it moves forwards slightly after being struck by the rod 14. A path 18 is a breathing path which is formed through the lower wall of the chamber 4 to help the rod 14 slide smoothly.

A plastic cap 19 is fixed to the front of the chamber 4.

A casing 20 is fixed to the bow-shaped structure 2 and covers the inlet pipe 10. The water tank 12 and the casing 20 form a single structure unit. A supply gate 12a feeds water to the water tank 12. A cap 12b covers the supply gate 12a. A rubber cap 21 covers the rear end of the rod 14.

The following section is an explanation, based on the drawings, of how to propel water from the water pistol with the construction detailed in the previous section.

Water is supplied to the water tank 12. The middle of the bow-shaped structure is gripped with one hand. The other hand grips the cap 21 at the rear end of the rod 14 and then the rod 14 is pulled backwards along the guide part 4b until the rod 14 reaches its hindmost position which is determined by the pin 15 a which point the bow-shaped structure 1 achieves a position of stability.

The target is taken aim at and then the rod 14 is released.

The restoring power of the bow-shaped structure 1 forces the rod 14 forward with the bowstring 2 along the guide part 4b until at its formost position the front end of the rod 14 strikes the rear of the cap structure 6a which then moves forward.

The elasticity of the bucket-shaped structure 6a causes the opening 7a to close and seal the pressure compartment 7. the capacity of the pressure compartment 7, subsequently, increasing the pressure on the water it contains. Due to the increasing pressure some of the water is discharged drop-shaped through the small hole 6c and then through the nozzle hole 13.

Following the discharge of the water the stability of the bucket-shaped structure 6a is restored forcing the rod 14 backwards to its original position and completing the operation.

An outside force is required only to pull the bowstring 2 backwards at the beginning of the operation. With the release of the bowstring 2 the utilization of the outside agent is completed. The stability of the bow-shaped structure 1 causes the force of discharge.

Furthermore, since the stability of the bow-shaped structure 1 is constant the pressure applied to the discharged water is constant and the subsequent stability of the trajectory of the discharged water increases the percentage of target hits.

In addition, the impact pressure of the rod 14 on the cap 6b applies a like impact on the water in the pressure compartment 7.

Thus, the water discharged is a drop-shaped and travels at high speed to the target on which it can make a clearly defined mark.

This feature of the water pistol forther promotes an increase in the percentage of target hits.

Figure 7:
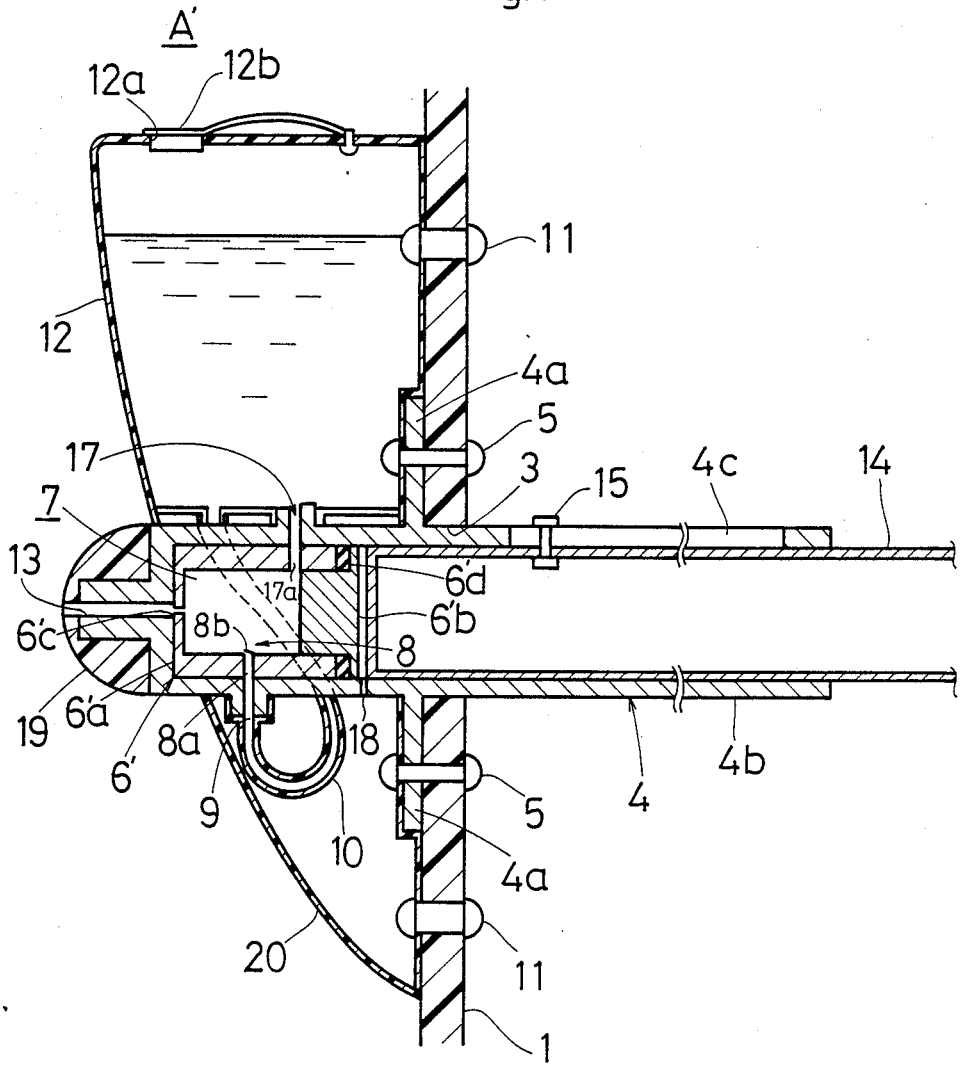
FIG. 7 is an equivalent of FIG. 1 for another embodiment of the present invention.

FIG. 7 illustrates another embodiment of this invention.

FIG. 7 is the equivalent of FIG. 1 and is labelled with the same number system and so a detailed explanation of such may be omitted here.

In this embodiment of the invention the bucket-shaped structure 6'a of the chamber 6' which is incorporated in the chamber 4 is constructed of a metallic material instead of a material with elastic properties as in the first embodiment of this invention. The cap 6'b which is made of a solid material such as metal cover the opening of the bucketshaped structure 6'a.

A spacer 6'*d* which is made of an elastic material is set between the cap 6'*b* and the opening of the bucket-shaped structure 6'*a*.

When the cap 6'*b* is struck by the front end of the rod 14 the elasticity of the spacer 6'*d* applies pressure on the water inside the pressure compartment 7.

The other parts of this embodiment are the same as previously described for the first embodiment of the invention.

Therefore, the effects of the change in construction for the second embodiment are esuch that the second embodiment functions with the same result as the first embodiment.

In the second and in the first embodiments of the invention the pressure compartment 7 in the chamber 4 is set in the chamber 6 or 6' which has some elastic material such as rubber as part of the structure. When the rear wall of the chamber 6 or 6' is struck by the front end of the rod 14 as it moves forward the pressure compartment 7 the decreases in size so that the water it contains is placed under increased pressured and partly discharged.

The action of the rod 14 may be repeated until all of the water inside the pressure compartment 7 has been discharged.

Each of the embodiments of the invention has a high degree of accuracy in terms of target hits.

In the embodiments previously described the bow-shaped structure 1 is constructed of an elastic material and the rod 14 is forced forward by the restoring power inherent in the elasticity of the bowshaped structure 1.

Is is also possible to construct the bow-shaped structure 1 of a rigid material. In this case if the bowstring 2 is constructed of an elastic material such as elastic rubber or similar materials the rod 14 will be forced forward by utilizing the restoring power of such a bowstring 1.

In addition, it is also possible that both the bow-shaped structure 1 and the bowstring 2 be constructed of elastic materials so that the rod 14 is forced forward by the restoring power of both parts.

As mentioned previously the restoring power of the bow-shaped structure or the bowstring 2 forces the rod 14 forward after the bowstring 1 strung on the bow-shaped structure 1 is drawn backwards.

The striking force of the rod 14 increases the pressure on the water contained in the pressure compartment 7 incorporated in the cylinder-shaped chamber 4.

Some of the water is discharged from the hole of the nozzle at a target.

Since application of power at the time of water discharged is not necessary the operation of discharge is made easy.

Furthermore, a fixed, stable increase of pressure on the water contained in the pressure compartment 7 ensures that the trajectory of the discharged water is stable. Thus, the purpose of this water pistol which is to achieve a high level of accuracy is satisfied.

The pressure compartment 7 is formed inside the box-shaped chamber which has some elastic material such as rubber, incorporated in the cylinder-shaped chamber 4.

The rear wall of the box-shaped chamber is struck by the front end of the rod 14 as it moves forward.

In this way the pressure compartment 7 decreases in size and the water it contains is placed under increased pressure.

Thus, a water drop is ejected at high speed from the hole of the nozzle. This, it is not only possible to successfully hit a target more often than previously possible but also to easily determine whether the target was hit.

What is claimed is:

1. A water pistol comprising of a bow-shaped structure and a bowstring strung between opposite edges of the bow-shaped structure with a pressure compartment of changeable capacity for containing water at the center part of the bow-shaped structure and also with a guide part which extends from the rear of the pressure compartment to the bowstring; a cylinder-shaped chamber, which contains both the pressure compartment and the guide part, defining a hole that connects the pressure compartment with a nozzle in its front wall; a rod in the guide part for moving back and forth with the rear part of the rod connected to the center of the bowstring; and one of the bow-shaped structure and the bowstring being made of an elastic material which has restoring power so that when the rod is drawn backward it is then forced to move forward applying pressure to the water in the pressure compartment whereby water is sprayed from the nozzle.

2. The water pistol set forth in claim 1 wherein the pressure compartment in the cylinder-shaped chamber is formed inside of a box-shaped chamber comprising resilient material; and the pressure compartment decreases in size so that the water contained therein is placed under pressure when the rear wall of the box-shaped chamber is struck by the front end of the rod as it moves forward.

* * * * *